US005109224A

United States Patent [19]

Lundberg

[11] Patent Number: 5,109,224

[45] Date of Patent: Apr. 28, 1992

[54] ROAD TRAFFIC SIGNALLING SYSTEM

[75] Inventor: Derek A. Lundberg, Royston, England

[73] Assignee: GEC-Marconi Limited, United Kingdom

[21] Appl. No.: 602,257

[22] PCT Filed: Apr. 11, 1990

[86] PCT No.: PCT/GB90/00558

§ 371 Date: Nov. 8, 1990

§ 102(e) Date: Nov. 8, 1990

[87] PCT Pub. No.: WO90/12382

PCT Pub. Date: Oct. 18, 1990

[30] Foreign Application Priority Data

Apr. 12, 1989 [GB] United Kingdom ..... 8908180

[51] Int. Cl.[5] ..... G08G 1/08

[52] U.S. Cl. ..... 340/907; 340/932; 340/928

[58] Field of Search ..... 340/907, 928, 932, 936, 340/938, 941, 901; 364/438

[56] References Cited

U.S. PATENT DOCUMENTS

| | | | |
|---|---|---|---|
| 3,052,869 | 9/1962 | Mountjoy | 340/941 |
| 3,078,944 | 2/1963 | Gray | 340/941 X |
| 3,302,168 | 1/1967 | Gray et al. | 340/932 |
| 3,921,127 | 11/1975 | Narbaits-Jaureguy et al. | 340/901 |
| 3,944,912 | 3/1976 | Angel et al. | 340/941 X |

FOREIGN PATENT DOCUMENTS

WO8807560 10/1988 PCT Int'l Appl. .

*Primary Examiner*—Jin F. Ng
*Assistant Examiner*—Brian R. Tumm
*Attorney, Agent, or Firm*—Kirschstein, Ottinger, Israel & Schiffmiller

[57] ABSTRACT

A system for signalling individually to a vehicle driver in a flow of traffic that he is too close in relation to has speed to the vehicle ahead. The system comprises a succession of interconnected electronic signalling units of the "cat's eye" type positioned at intervals along the road. Each signalling unit detects and times the passage of vehicles past the unit, determines the distance to the vehicle ahead and communicates with adjacent units. Signalling to the driver may be direct by light signals emitted from units in front of his vehicle, or indirect by transmitting a local signal from each unit for detection by vehicle-borne receivers.

27 Claims, 6 Drawing Sheets

6

ROAD TRAFFIC SIGNALLING SYSTEM

BACKGROUND OF THE INVENTION

1. Field of the Invention

This invention relates to a road traffic signalling system, and in particular to a system for signalling individually to vehicles in a flow of traffic.

2. Description of Related Art

A major factor influencing road safety is the difficulty drivers of vehicles face in assessing distance, in particular a safe distance to the vehicle ahead. In conditions of poor visibility, such as fog, the problem is exacerbated by the lack of visual reference points from which a driver can judge his speed and it is well established that multiple crashes are often caused when successive vehicles in a flow of traffic become too closely spaced in relation to their speed.

International (PCT) Patent Publication No. WO-88/07560 describes a vehicle guidance and proximity warning system in which a series of "cat's eye" units embedded in the road are interconnected by optical fibres. The light received by any one unit from the headlights of an approaching vehicle is transmitted to neighbouring units. By transmitting light in a forward direction (relative to the direction of travel) the path of the road ahead is lit up. Alternatively, by transmitting light in a rearward direction, a warning is provided to a following vehicle of the vehicle ahead. Although the rearward lights provide an improved indication of traffic ahead in conditions of poor visibility, a simple passive system of this type can make no assessment of vehicle speed—an essential factor in determining the safe distance between vehicles.

A more complicated system, described in United Kingdom Patent Specification No. 1,090,091, provides for the illumination of lights in "cat's eye" units both ahead of and behind a vehicle. Two forward lights are arranged to come on after respective fixed delays from the detection of a vehicle, so that if the vehicle is exceeding a speed limit determined by the time delay and the separation of the light units, the vehicle will literally "over-ride" the lights and they will not be visible to the driver. Thus, although vehicle speed is not itself measured, an indication of speed in excess of a preset limit is provided. Each vehicle detected also causes to be set up a fixed pattern of "tail" lights to the rear of the vehicle. These tail lights are colour-coded according to the distance from the vehicle, so that a following driver receives an indication of his distance from the vehicle ahead as he closes up on it. However, the distance signals are fixed and take no account of vehicle speed. Thus, in order to judge a safe distance from the vehicle ahead, and assuming he does not over-ride his own forward lights, a driver has to take account of his own speed *and* the distance to the vehicle ahead, based on which of the tail signals associated with that vehicle are visible to him. There is no direct indication of safe distance as determined from measurement of vehicle speed.

SUMMARY OF THE INVENTION

It is an object of this invention, therefore, to provide an improved road traffic signalling system to warn vehicle drivers of unsafe traffic conditions, in particular in relation to vehicle position and speed.

According to the invention there is provided a road traffic signalling system for signalling individually to vehicles in a flow of traffic, the system comprising a succession of electronic signalling units positioned at intervals along a road, each unit comprising:

(a) a detector for detecting the local presence of a vehicle, (b) timing means for determining vehicle speed past the unit, (c) communicating means for communicating with adjacent units, (d) coding means for transmitting back a coded signal indicative of a vehicle detected at a unit ahead, (e) signalling means for signalling to vehicles approaching the unit, and (f) a processor responsive to signals from the local detector and the local timing means and to a said coded signal received by the communicating means, to control the signalling means in response to traffic conditions.

For respective pairs of adjacent units, the timing means of the forward unit is preferably controlled in response to the successive detections of a vehicle at the rearward unit and the forward unit to give a time interval indicative of vehicle speed past the forward unit. Alternatively, the timing means may be adapted to determine vehicle speed by measuring a time interval during which the output of the detector exceeds a predetermined threshold value.

The coded signal is initiated by the detection of a vehicle at a unit (the originating unit) and is transmitted back from unit to unit by means of the communicating means. Preferably, the coding means of each unit modifies the coded signal so that, at any unit, the coded signal is indicative of the distance to the originating unit. Alternatively, the coded signal may carry an identification code representative of the originating unit, the processor of each unit being adapted to determine from the identification code the distance to the originating unit.

According to a feature of the invention, the processor of each unit is adapted to predict from said distance and said time interval, the time lapse before a vehicle at that unit will reach the originating unit of the coded signal, and to control the signalling means of neighbouring units to that unit in dependence upon the predicted time lapse. The neighbouring units preferably comprise the units ahead as far as the originating unit.

BRIEF DESCRIPTION OF THE DRAWINGS

A road traffic signalling system in accordance with the invention will now be described, by way of example only, with reference to the accompanying drawings of which.

DETAILED DESCRIPTION OF THE PREFERRED EMBODIMENT

Figure 1:
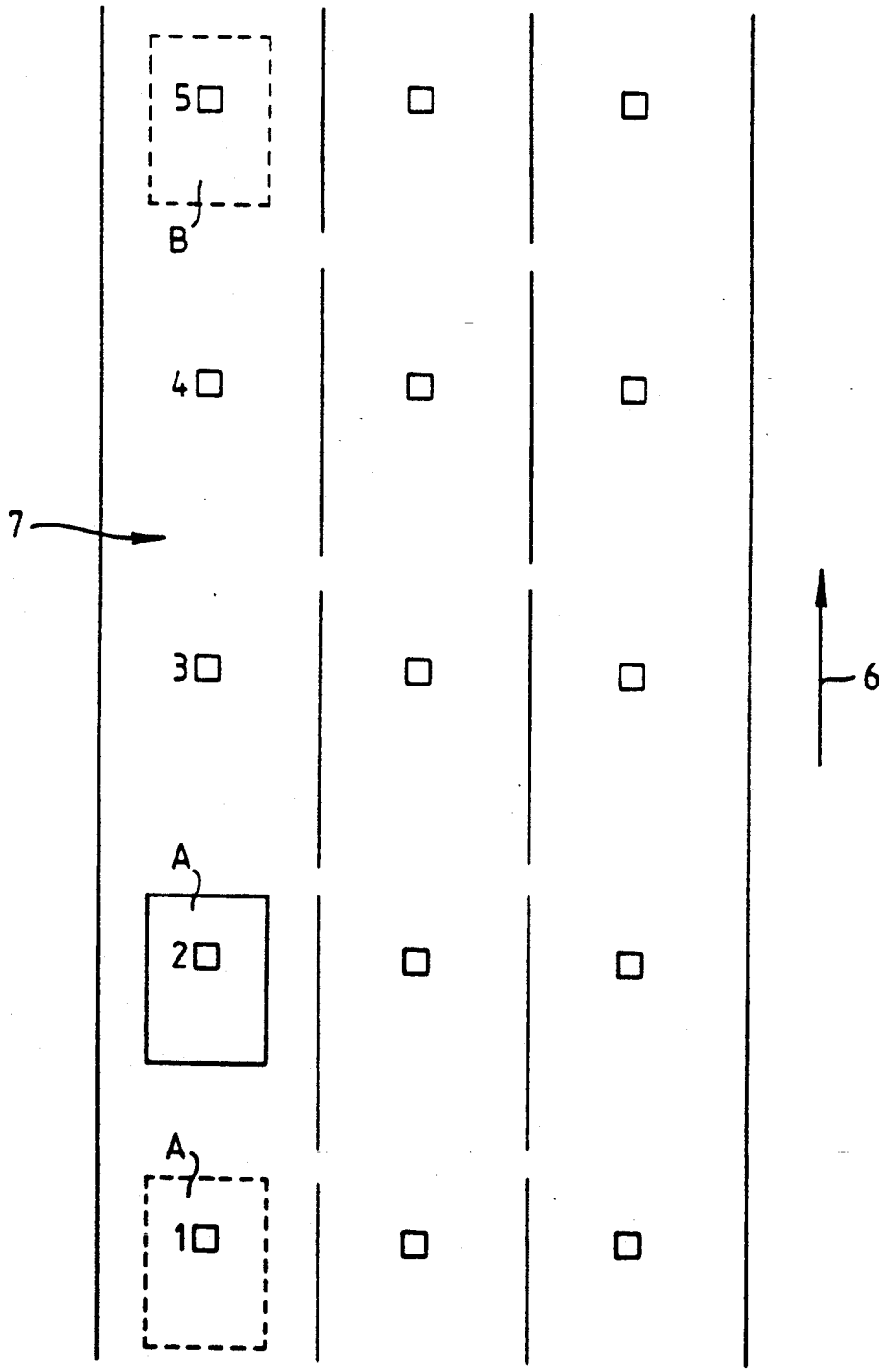
FIG. 1 is an illustration of a simple traffic scenario of two vehicles in a traffic lane.

In FIG. 1 two vehicles A and B occupy one traffic lane 7 of a road; The direction of traffic is indicated by the arrow 6. Embedded in the centre of the lane 7 and positioned at regular intervals along the lane is a series of electronic signalling units, of which five, 1 to 5, are shown. In appearance the units resemble conventional "cat's eyes". However, instead of having passive light reflectors, the units 1 to 5 are electrically powered devices, each housing a bank of lights and active electronic circuitry. Each unit performs a number of functions, including controlling its own lights, detecting and timing the passage of vehicles and signalling to neighbouring units, the principal goal being to indicate to a vehicle driver that he is too close, in relation to his speed, to the vehicle ahead. Light signals from the units flow along with the vehicle for which they are generated so as to be continuously visible to the driver as he advances along the road. Although the signals provided by the system will be useful to drivers in normal road conditions and especially at night, their greatest value will be in conditions of poor visibility, such as fog or smog, when judgement of distance and speed becomes more difficult.

It will be appreciated that other facilities may be added to the basic system for the performance of subsidiary functions. For example, there may be provision for:

(i) indicating to a driver that there is slow-moving traffic ahead in his lane;

(ii) indicating to a driver that he is exceeding the local speed limit;

(iii) detecting and indicating the presence of ice, fog or surface water;

(iv) adjusting the light signals to take account of these conditions.

Figure 5:
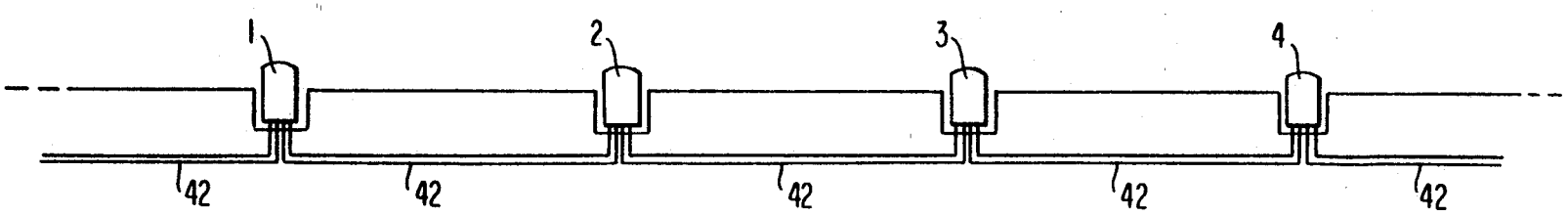
FIG. 5 is an illustration of the cabling between units.

The construction of the signalling units 1 to 5 will be described in detail later, but, for now, the basic principles of operation of the system will be considered. The signalling units are positioned preferably centrally within each traffic lane and spaced a suitable distance apart (say, 5 meters). They are powered by a common electric cable buried in a slot along the road. Signalling between neighbouring units is achieved by individually interconnecting adjacent units. The interconnecting cabling may be electrical or fibre optic. Fibre optic cabling 42 between units 1 to 4 is shown in FIG. 5. Signals which it is required to transmit to a number of units are relayed from unit to unit by means of the cabling. In an alternative arrangement, however, each signalling unit may be powered by a rechargeable battery linked to a solar cell exposed to daylight and vehicle headlight. Signalling between such independently-powered units may be achieved by means of low-power ultrasonic or electromagnetic radiation, each unit having an individual transmitter/receiver module. No cabling is then required between the units and they may be easily removed, replaced or fitted temporarily in the road surface.

Each signalling unit comprises:

(i) a light emitting means in the form of a bank of three high-intensity coloured lights (red, amber and green), the beams from which are directed through an optical element so as to be visible to passing drivers;

(ii) a vehicle detector to detect the presence of a vehicle adjacent the unit; and (iii) electronic circuitry including a timing means, such as a clock, for providing vehicle timing (speed) data, a coding means adapted to transmit back a coded signal indicative of a vehicle detected at a unit ahead, and a processor for performing data processing and light control functions.

Returning to FIG. 1, vehicle B is shown passing unit 5 and a following vehicle A (in full lines) is adjacent unit 2. When a vehicle passes a signalling unit the following things happen:

(a) the vehicle passage is detected;

(b) a signal is sent to the next unit ahead instructing that unit to start its clock;.

(c) the clock in the unit being passed is stopped, giving the time interval in which the vehicle has travelled from the previous unit, which, with known distance between adjacent units, provides a measure of vehicle speed;

(d) a coded signal is initiated by the coding means of the unit being passed, and this signal is sent in a rearward direction, being relayed from unit to unit, until the signal reaches a unit where a vehicle (the following vehicle) has been detected; at this unit the coded signal is supplied to the local processor and a new coded signal is generated by the local coding means for transmission further back along the traffic lane;

(e) the processor determines from the coded signal the number of units (and therefore the distance) to the vehicle ahead;

(f) at each unit where a vehicle has been detected, the processor is supplied with the distance and time data of steps (c) and (e) and determines according to pre-programmed rules, whether or not the passing vehicle is too close, in relation to its speed, to the vehicle ahead;

(g) if it is determined that the vehicle is at least a minimum safe distance from the vehicle ahead, a signal is sent ahead to illuminate the green lights on, say, the next 6 units forward;

(h) if it is determined that the distance between the vehicles is not safe, a signal is sent to, say, the next 6 units forward of the following vehicle to switch on either their amber lights or red lights, according to the degree of danger which the distance and speed of the vehicles represents;

(i) if, in the case of (g) or (h) above, there are fewer than 6 units between the two vehicles, only the light emitting means in the units between the two vehicles will be activated so that light signals intended for the driver of a following vehicle will not become visible to the driver of the vehicle ahead;

(j) lights in the unit being passed are extinguished, although they may subsequently be turned on again after the vehicle has passed the unit in response to the presence of another following vehicle;

(k) if a vehicle slows down to a speed below a set limit, then, as an optional subsidiary function, a separate rearward signal may be generated instructing the 40 (say) units to the rear to show a flashing red signal and the 40 (say) units beyond those to show a flashing amber signal. This rearwardly directed signal is arranged to over-ride the normal signalling.

It should be noted that in steps (g) and (h) above, the light control signal is transmitted initially only to the next adjacent unit ahead. The signal is successively transmitted forward by each unit in the chain in "bucket-brigade" fashion.

Referring again to FIG. 1, the processor in unit 2 is supplied with two pieces of information, the coded (distance) signal originating from unit 5, indicating the presence and distance of the vehicle B ahead, and a time (speed) value representing the time interval in which vehicle A has travelled from unit 1 (where vehicle A is shown dotted) to unit 2. This data may be used to predict the time lapse before vehicle A will reach the position at that moment of vehicle B (i.e. unit 5) if it continues at the same speed. Thus, the safety determination made in step (f) above may be achieved by a simple multiplication of the number of units between the vehicles A and B (provided by the coded signal in step (e) above) and the time interval indicative of vehicle A's speed (determined by step (c) above). Such a calculation of the predicted time lapse effectively gives the time delay between two successive vehicles passing a given point on the road. It may be used to determine whether the vehicles are safely spaced by comparison with a predetermined minimum safe value or range of values, as explained later. The result of the comparison determines which signals are presented to the driver of vehicle A.

Figure 2:
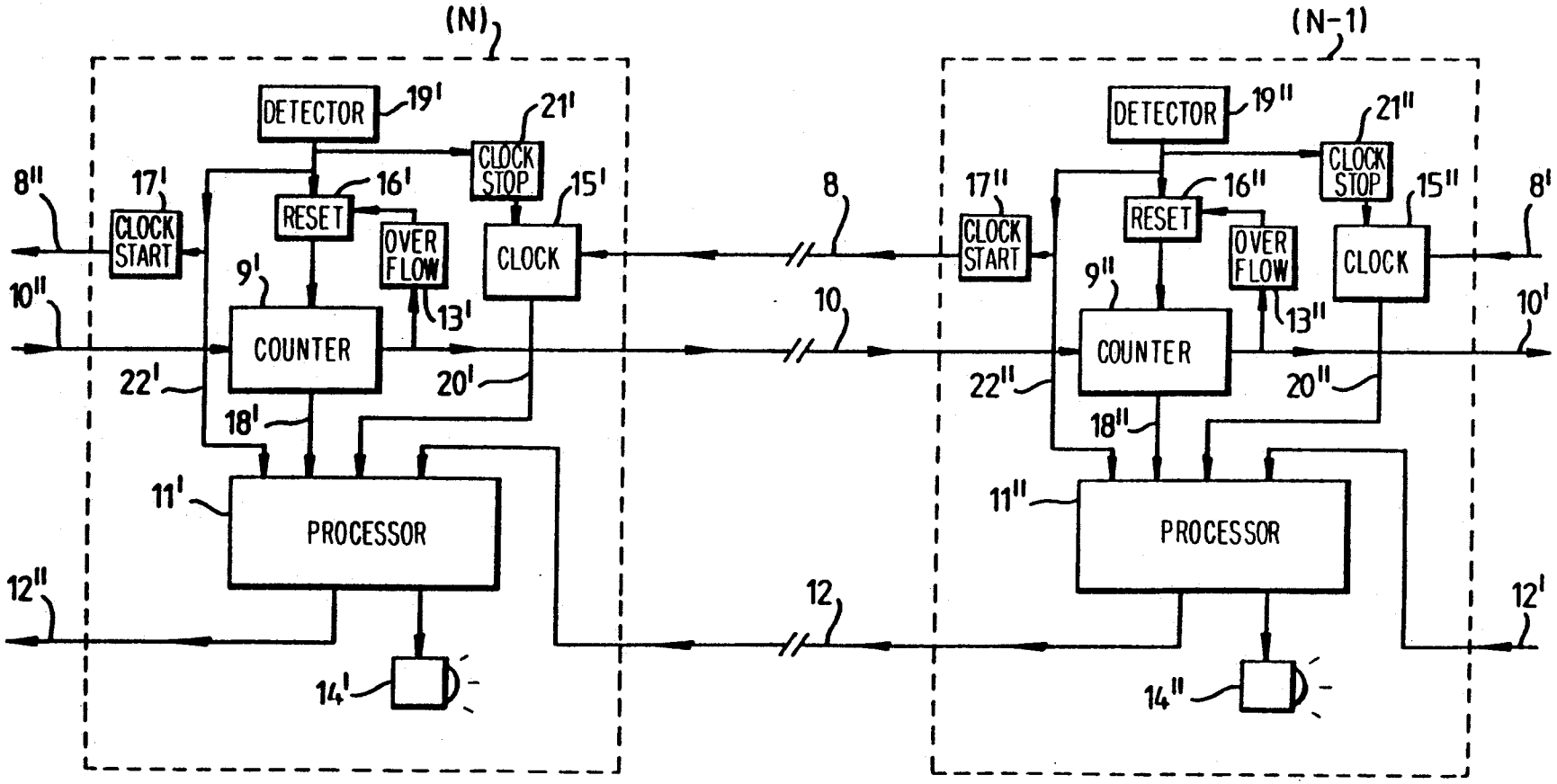
FIG. 2 is a block diagram of two electronic signalling units for use in accordance with the invention and illustrating interconnection of the units.
Figure 4A:
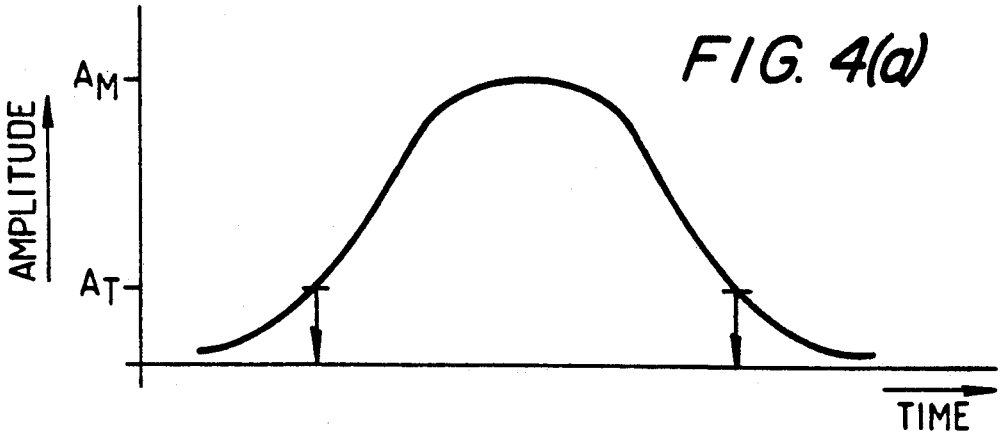
FIGS. 4(*a*) and 4(*b*) show the response characteristics of one type of vehicle detector for use in a signalling unit.
Figure 4B:
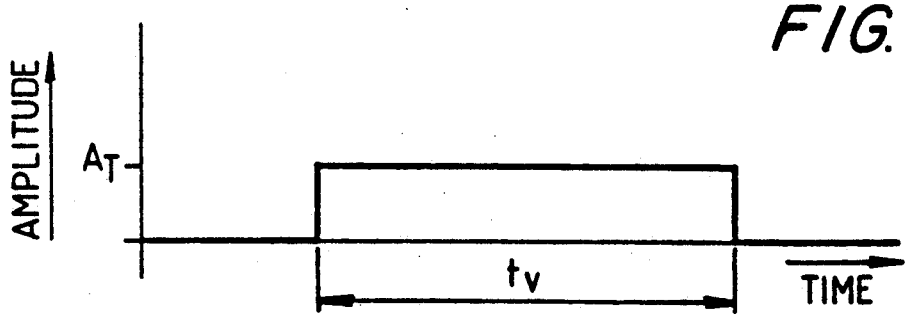

FIG. 2 is a block diagram of a basic scheme for the system showing features of each signalling unit and the interconnection of two such units. Each signalling unit is capable of performing the steps (a) to (j) above. To achieve the function described in (k) above, i.e. to indicate slow-moving traffic, requires some modification of the scheme shown in FIG. 2, including the provision of a facility for timing the period for which a vehicle remains inside the sensitive range of a signalling unit's vehicle detector and for transmitting a light control signal in the rearward direction. This function is described more fully later with reference to FIG. 4. In FIG. 2, for simplicity, only the basic system requirements, that is to switch the lights on to indicate a dangerous traffic condition and off in all other circumstances, will be considered. It will be appreciated that in a simple system of this nature, each signalling unit may comprise a pair of lights, one permanently powered at night and in conditions of poor visibility for road guidance purposes and the other controlled by the system units to provide traffic signalling.

FIG. 2 shows two signalling units, unit (N) and unit (N-1) and their interconnection. In a complete system, the two units would, of course, form part of a long chain of such units, adjacent units being interconnected in the same manner. With reference to unit (N), each signalling unit comprises essentially a vehicle detector 19' for detecting a vehicle adjacent the unit, a coding means in the form of a counter 9' for receiving, generating and transmitting vehicle distance information by means of a coded signal, a clock 15' for vehicle speed measurement, a light emitting means 14' for providing traffic signals and an electronic processor 11' for controlling the operation of the unit.

The two units, (N) and (N-1), are shown interconnected by three separate signal lines 8,10 and 12, which carry essential system signalling information between the two units. As will be explained later, all three signals may be carried on a single data link by the use of multiplexing techniques. However, for the purpose of clarity of description, three separate signal paths will be considered. The direction of traffic flow is indicated by the arrow 6. Thus, the line 8 carries a 'clock-start' signal in the forward direction from unit (N-1) to unit (N). The line 10 carries a 'count' (or distance) signal in a rearward direction from unit (N) to unit (N-1). This count signal may be relayed by unit (N-1) to the next unit back (not shown) by means of line 10'. The line 12 carries a 'light control' signal in the forward direction from unit (N-1) to unit (N) to control the light emitting means 14' in unit (N) via the processor 11'.

Considering first the count (distance) signal carried by line 10, counter 9' in unit (N) is started when a vehicle is detected at the unit by a vehicle detector 19'. The counter 9' generates a count signal which is sent back to the unit (N-1), where counter 9'' increments the count and relays the count signal back to the next unit (not shown) by means of line 10'. This count signal continues to be sent back and the count incremented by each unit in the chain until it reaches the next unit at which a vehicle has been detected. Assume, for example, that a vehicle has been detected at unit (N-1). The count at that unit is supplied to local processor 11'' on line 18''. The counter 9'' is reset by reset circuit 16'' and a fresh count signal is generated and transmitted via line 10'. Thus processor 11'' of unit (N-1) at which the vehicle has been detected has a count of the number of units to the next vehicle ahead, which count represents the distance between the vehicles. In conditions when traffic is light and there is considerable separation between vehicles it is not necessary for the count signal to be sent back further than some predetermined number of units. Thus, each counter 9 is provided with an overflow monitor 13 so that if the count reaches a preset maximum, the counter is stopped and the maximum count is held. When a vehicle is next detected at that unit, the counter is reset and re-started by means of the reset circuit 16. If a following vehicle is so far behind the vehicle in front that the counter in the unit at which it is detected holds the maximum count, the processor will interpret the maximum count signal as meaning that the vehicle ahead is a safe distance away, regardless of the speed of the local (following) vehicle.

The clock-start signal carried by line 8 is used for time (speed) measurement. Each signalling unit has its own timing clock 15 which receives a start signal from the unit behind generated by a circuit 17. The circuit 17 is triggered by the detection of a vehicle at that unit. Thus, when a vehicle is detected at a unit, a signal is transmitted in a forward direction to start the clock in the next unit ahead. For example, referring to FIG. 2, when a vehicle is detected by detector 19'' of unit (N-1), a clock-start signal is generated by circuit 17'' to start the clock 15' in unit (N). When the vehicle reaches unit (N) the clock 15' is stopped and reset by circuit 21'. At the same time the clock-start signal is generated by circuit 17' and transmitted on line 8'' to the clock in the next unit ahead (not shown). The time interval for the vehicle to travel from unit (N-1) to unit (N) is provided by clock 15' to the processor 11' in unit (N) on line 20'. Since the spacing of the units is a known distance, this time interval is representative of vehicle speed.

Thus, the processor 11 in each unit has available the following information:

(i) whether there is an adjacent vehicle (from the output on line 22 of detector 19), (ii) the distance to the next vehicle ahead (from the output on line 18 of counter 9), and (iii) the speed of an adjacent vehicle (from the output on line 20 of clock 15).

Further, the processor in each unit receives a light control signal on line 12 for controlling its light emitting means 14. If there is no vehicle present at a unit, the processor may also pass this signal to the next unit ahead so that a series of lights can be illuminated ahead of a unit at which a vehicle has been detected. For example, a signal received on line 12 by processor 11' in unit (N) will be transmitted to the next unit ahead via line 12'', provided no vehicle has been detected by detector 19'. If a vehicle is detected at unit (N), the associated light 14' is extinguished and control for the lights of the units ahead originates from the local processor 11'.

This mode of operation ensures that signals to control the lights ahead of a unit are not transmitted beyond the unit adjacent the vehicle ahead, where they could present misleading information to other drivers. Control of the lights in each unit is achieved by means of the local processor and is based on the information listed in (i) to (iii) above, plus the light control information provided on line 12 by the processor in the unit behind. It is seen, therefore, that there are three basic signals which it is required to exchange between adjacent signalling units; two forward-going signals, the clock-start and light control signals, and one rearward-going signal bearing the count (distance) information. The three signals may be carried by a single electric cable or optical fibre by the use of frequency division multiplex (FDM) or time division multiplex (TDM) techniques or by using respective cables or fibres. Signals travelling in the same direction may be combined and coded in the form of a multi-digit number in which specific digits, or groups of digits, represent different signal information. If this mode of signalling is adopted the multi-digit number signal is supplied directly to the processor for decoding to extract the required control information.

The specific methods described above for measuring the speed, time and separation of vehicles and for the communication of this information between adjacent signalling units are given by way of example only. Other methods will be apparent to those skilled in the art. For instance, the vehicle speed assessment may be made by measuring the period for which a vehicle remains inside the sensitive range of the detector of a local unit. It will also be appreciated that the essential requirement of the count (distance) signal is that it provides at any unit an indication of the distance to the originating unit. This may be achieved, as described, by a simple counting process initiated by the detection of a vehicle at the originating unit. Alternatively, the counter 9 in each unit may be replaced by a signal generator. If each unit is allocated an identification code, which can be carried by a coded signal generated by the signal generator on detection of a vehicle, then a simple comparison of the coded signal received by a given unit with its own identification code will enable the required distance data to be obtained. The comparison function may be conveniently performed by the unit processor.

Figure 3:
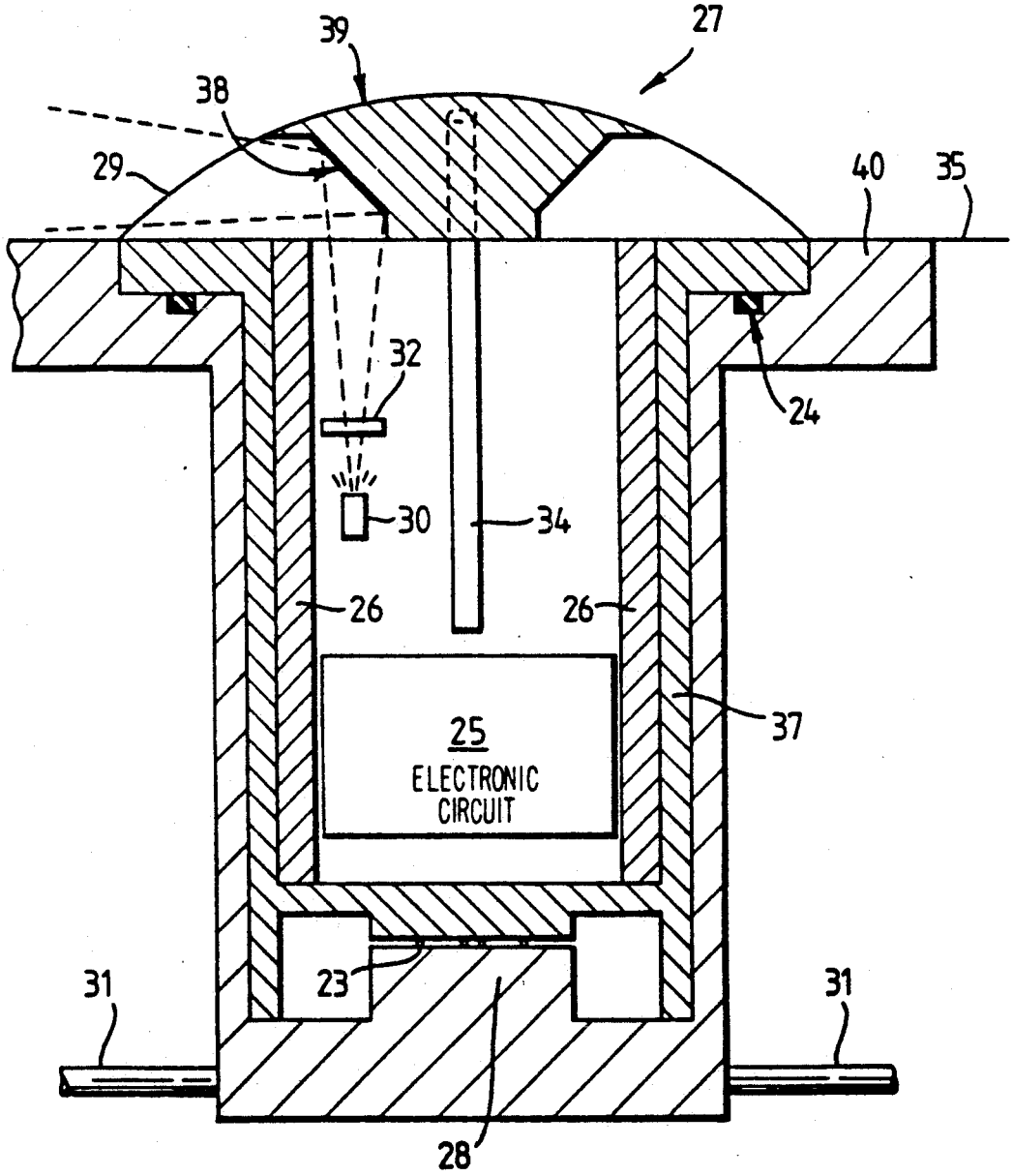
FIG. 3 is a schematic illustration of the construction of a signalling unit.

A brief description will now be given, by way of example, of one construction of the signalling unit. FIG. 3 is a part-sectioned schematic illustration of one unit 27. A housing 40 accommodating the unit 27 is permanently embedded in the road surface 35 and connected by cable 31 to the two neighbouring units. The unit 27 comprises a cylindrical body 37 having a domed upper surface 39 carrying an optical element 29 for emitting light. The cylindical body 37 carries a flange fitting into the housing 40 and having a hermetic seal 24. Electrical connections to the unit are made via a plug 23 at the base of body 37 which mates with a socket 28 in the housing 40. A solenoid 26 mounted on a ferromagnetic core constitutes a vehicle detector for the unit.

In a system providing three light signals—red, amber and green—there are respective light sources 30, of which one only is shown in FIG. 3. A bank of optical filters 32 (one only shown) comprises one filter each for green, amber and red light. The light sources 30 are aligned with their associated filters 32 so that, by selecting the appropriate source, the light emitted through the element 29 is either red, amber or green. The element 29 is designed to reflect light out of the unit by total internal reflection at the surface 38.

An electronic circuit 25 comprising the clock, counter and processor of the unit is sealed within the body 37 of the unit, with external connections (not shown) to the plug 23, the detector solenoid 26 and the light sources 30.

The vehicle detector need not necessarily be a magnetic type. However, this type of detector produces a particularly suitable pulse type output (FIG. 4(*a*)) when a vehicle passes the unit. Other vehicle sensing techniques are well known in the art. Some of these are reviewed in Vehicle Detection—Taylor, Bell and Thancanamootoo (Highways & Transportation, June 1987). An advantage of the pulse output (FIG. 4(*a*)) is that it can be used to detect slow-moving traffic. The separation between adjacent signalling units along the road should be such that a vehicle is always within the sensitive detection range of one of the signalling units, i.e. adjacent units must be sufficiently close that a vehicle does not become "lost" between them. By setting a threshold $A_T$ at an appropriate proportion of the peak output amplitude $A_M$, a square wave pulse (FIG. 4(*b*)) can be generated, the duration of which gives the interval $t_v$ in which a vehicle remains within the sensitive range of the detector. This interval can be used to detect slow-moving traffic for the purposes of signalling back to following vehicles, as already mentioned. To provide this function a further clock is needed, being controlled in response to the detector output crossing the threshold amplitude $A_T$. The interval $t_v$ for which the detector output exceeds the threshold $A_T$ is supplied to the local processor for comparison with a fixed reference to determine whether the vehicle detected is slow-moving. When a slow-moving vehicle is so detected a light control signal is transmitted back to a number of units to the rear to warn traffic of the presence of the slow-moving vehicle. This warning signal may be arranged to over-ride the normal 'safe distance' signals and may be such that it causes the amber lights (say) to flash to avoid the possibility of confusion with the other signals. The rearward-going light control signal is not constrained from being relayed back beyond the next vehicle, so the warning lights will be visible to a number of following vehicles.

The threshold for defining detection of a vehicle is set at a level above the amplitude of the detector output when the vehicle is mid-way between two adjacent units. In this way, for the purpose of vehicle detection a vehicle is unambiguously detected by a single signalling unit at any given position on the road.

As already mentioned, a major factor in road safety, particularly on motorways and main highways, is the distance between vehicles in relation to their speed. This is equivalent to the interval $t_D$ between successive vehicles in a traffic lane passing a fixed point on the road. The generally accepted safe interval for good road conditions is not less than 2 seconds. In the system described, the interval $t_D$ is calculated in the processor of each unit at which a vehicle has been detected to give a predicted time for the vehicle at that unit to reach the current position of the next vehicle ahead. The calculation is a simple multiplication of the time the vehicle concerned has taken to travel from the previous unit to the current unit, and a number which is (strictly) one more than the number of units between the two vehicles.

Each signalling unit can show to approaching drivers either a red, amber or green light. At each unit, the interval $t_D$ is calculated as a vehicle passes and is then compared with one or other of a set of number-pairs. Acceptable values of $t_D$ for different road conditions are given, by way of example, in Table 1 below.

TABLE 1

| $t_D$ | | ROAD |
|---|---|---|
| GREATER THAN | LESS THAN | CONDITIONS |
| 1.5 | 2 | GOOD |
| 1.75 | 2.25 | WET SURFACE |
| 2 | 3 | ICE |
| 2 | 4 | FOG |

In a simple system there may be a fixed minimum acceptable value of $t_D$ pre-programmed in the processor circuit of each signalling unit. Otherwise, the appropriate number-pair may be selected automatically by the processor in response to signals from road condition sensors (described below). Alternatively, the number-pair may be determined at roadside stations positioned at intervals of, say, 1 km along the road, each station controlling a local group of, say, 200 signalling units. Such roadside stations may also provide the power for each group of units, as well as collecting traffic count and other statistical information relating to road usage for transmission to a central control system. Signal information may be transferred between the signalling units and their associated roadside station by means of a common power cable for each group of units.

The outcome of the comparison between the calculated value of $t_D$ and the appropriate pair of values is used by the processor in each unit to determine which colour lights are to be presented to a driver.

Potential icing conditions occur when the road surface temperature falls to 0° C. or less. Thus, to detect road ice, a temperature sensitive element or probe 34 may be built into the exposed surface 39 of the unit 27 (FIG. 3). The output of the temperature probe 34 is supplied to the processor in each unit, so that a different pair of $t_D$ values is selected when the temperature is such that ice is likely to be present on the road. The detection of surface water on the road is a similarly useful facility to incorporate into the signalling unit. The presence of water may be detected by measuring the conductivity between two mutually insulated electrodes (not shown) mounted flush with the exposed surface 39 of the unit 27.

Fog can be detected in several ways, one of the more sensitive methods being to measure the light back-scattered from fog particles using a detector co-located with a light source. Typically, the light source is a modulated beam of infra-red radiation and the detector has a narrowband response centred on the modulation frequency. Although it is not practical to incorporate a fog sensor into the signalling units, signals from roadside fog sensors could be fed to local units to control the range of the safe time interval $t_D$ selected by the processors. Signals from such fog sensors may be supplied to the signalling units via the nearest roadside station.

It will be appreciated that although the signalling unit described has an individual processor, some of the processing electronics may be more conveniently housed in the roadside station associated with each local group of units.

Figure 6:
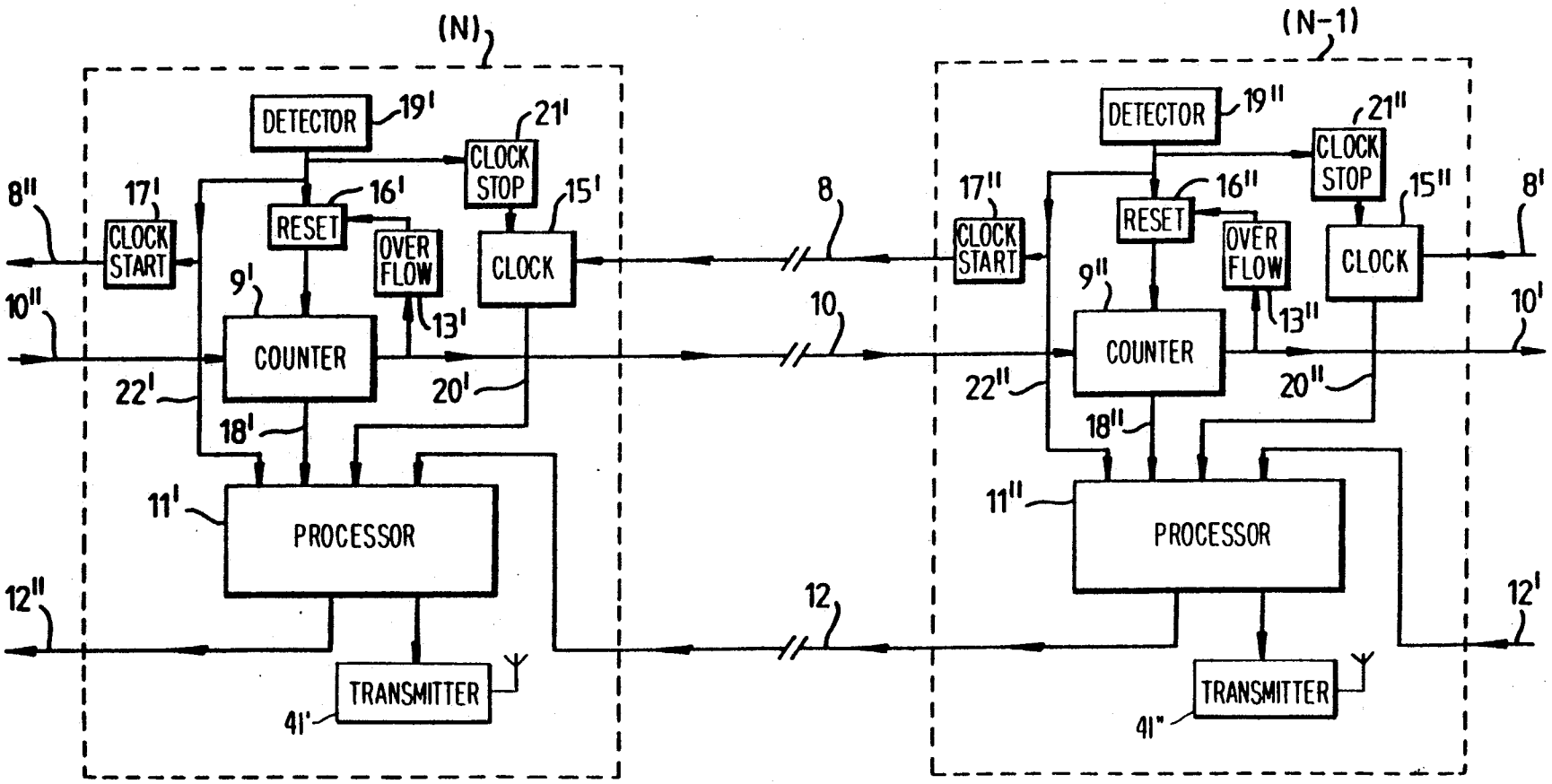
FIG. 6 is a view analogous to FIG. 2, but of an alternative embodiment of the invention.

In an alternative embodiment of the invention, illustrated in FIG. 6 the signal for controlling the light emitting means of each unit may be supplied to a transmitter 41', 41'' adapted to generate a local electromagnetic field capable of being detected by a receiver on the passing vehicle. In this way, instead of signalling directly to the driver by way of lights on the road, the same information may be received by an audible or visual signal generated inside the vehicle. Transfer of the local signal information from the signalling unit to the vehicle-borne receiver may be by inductive coupling or by way of an RF carrier signal. One advantage of such an arrangement may be a reduction in the power consumption of the signalling units resulting from removal of the light emitting means.

I claim:

1. A road traffic signalling system for signalling individually to vehicles in a flow of traffic flowing in a forward direction, the system comprising a succession of electronic signalling units positioned at intervals along a road, each of said units comprising:

(a) a detector for detecting the local presence of a vehicle, (b) timing means for determining the speed of said vehicle past said unit, (c) communicating means for communicating with those of said units adjacent to said unit;

(d) coding means for transmitting via said communicating means and in a reverse direction, opposite to said forward direction, a coded signal indicative of a second vehicle detected at one unit of said units ahead in said forward direction, there being a spacing between said vehicle and said second vehicle;

(e) a processor responsive to said detector and said timing means and to said coded signal received by said unit, to produce a control output for transmission via said communicating means, said control output relating to a safe distance determination based upon said speed and said spacing; and (f) light emitting means responsive to said control output for signalling to vehicles in said flow of traffic.

2. A road traffic signalling system according to claim 1, wherein for respective pairs of adjacent said units, each of said pairs comprising a forward unit and a rearward unit, the timing means of said forward unit is controlled in response to the successive detections of said vehicle at said rearward unit and said forward unit to give a time interval indicative of vehicle speed past said forward unit.

3. A road traffic signalling system according to claim 2, wherein said coded signal is initiated by the detection of said vehicle at a first said unit and is transmitted in said reverse direction successively between said adjacent units by means of said communicating means, the coding means of each said unit modifying said coded signal so that, at any said unit, said coded signal is indicative of the distance between said unit and said first unit.

4. A road traffic signalling system according to claim 2, wherein said coded signal is initiated by the detection of said vehicle at a first said unit and is transmitted in said reverse direction successively between said adjacent units by means of said communicating means, said coded signal carrying an identification code representative of said first unit, the processor of each said unit being adapted to determine from said identification code the distance between said unit and said first unit.

5. A road traffic signalling system according to claim 3 or claim 4, wherein the processor of each said unit predicts from said distance and said time interval, the time lapse before said vehicle at said unit will reach said first unit, and controls the light emitting means of said units neighboring said unit in dependence upon the predicted time lapse.

6. A road traffic signalling system according to claim 5, wherein said neighboring units comprise those of said units between said unit and said first unit.

7. A road traffic signalling system according to claim 6, wherein said communicating means transmits to the adjacent said unit in said forward direction, a first signal for controlling the timing means of said adjacent unit, and a second signal constituting said control output.

8. A road traffic signalling system according to claim 1, wherein said timing means determines vehicle speed by measuring a time interval during which said detector produces a detector output exceeding a predetermined threshold value.

9. A road traffic signalling system according to claim 1, wherein said detector comprises a solenoid having a ferromagnetic core, said solenoid having an inductance, and said local presence of said vehicle is detected by a change in said inductance.

10. A road traffic signalling system according to claim 1, wherein said light emitting means emit light of more than one colour in dependence upon said control output.

11. A road traffic signalling system according to claim 1, wherein said light emitting means are adapted to flash in dependence upon said control output.

12. A road traffic signalling system according to claim 1, wherein said communicating means comprises electric cabling interconnecting adjacent said units in said succession of units.

13. A road traffic signalling system according to claim 1, wherein said communicating means comprises fibre optic cabling interconnecting adjacent said units in said succession of units.

14. A road traffic signalling system according to claim 1, wherein said electronic signalling units are positioned substantially centrally within a traffic lane of said road.

15. A road traffic signalling system for signalling individually to vehicles in a flow of traffic flowing in a forward direction, the system comprising a succession of electronic signalling units positioned at intervals along a road, each of said units comprising:

(a) a detector for detecting the local presence of a vehicle, (b) timing means for determining the speed of said vehicle past said unit, (c) communicating means for communicating with those of said units adjacent to said unit;

(d) coding means for transmitting via said communicating means and in a reverse direction, opposite to said forward direction, a coded signal indicative of a second vehicle detected at one unit of said units ahead in said forward direction, there being a spacing between said vehicle and said second vehicle;

(e) a processor responsive to said detector and said timing means and to said coded signal received by said unit, to produce a control output relating to a safe distance determination based upon said speed and said spacing; and (f) a transmitter for transmitting said control output by means of a local electromagnetic field for detection by vehicle-borne receiving equipment.

16. A road traffic signalling system according to claim 15, wherein for respective pairs of adjacent said units, each of said pairs comprising a forward unit and a rearward unit, the timing means of said forward unit is controlled in response to the successive detections of said vehicle at said rearward unit and said forward unit to give a time interval indicative of vehicle speed past said forward unit.

17. A road traffic signalling system according to claim 16, wherein said coded signal is initiated by the detection of said vehicle at a first said unit and is transmitted in said reverse direction successively between said adjacent units by means of said communicating means, the coding means of each said unit modifying said coded signal so that, at any said unit, said coded signal is indicative of the distance between said unit and said first unit.

18. A road traffic signalling system according to claim 16, wherein said coded signal is initiated by the detection of said vehicle at a first said unit and is transmitted in said reverse direction successively between said adjacent units by means of said communicating means, said coded signal carrying an identification code representative of said first unit, the processor of each said unit being adapted to determine from said identification code the distance between said unit and said first unit.

19. A road traffic signalling system according to claim 17 or 18, wherein, to produce said control output, the processor of each said unit predicts from said distance and said time interval, the time lapse before said vehicle at said unit will reach said first unit.

20. A road traffic signalling system according to claim 15, wherein said timing means determines vehicle speed by measuring a time interval during which said detector produces a detector output exceeding a predetermined threshold value.

21. A road traffic signalling system according to claim 15, wherein said detector comprises a solenoid having a ferromagnetic core, said solenoid having an inductance, and said local presence of said vehicle is detected by a change in said inductance.

22. A road traffic signalling system according to claim 15, wherein said communicating means comprises electric cabling interconnecting adjacent said units in said succession of units.

23. A road traffic signalling system according to claim 15, wherein said communicating means comprises fibre optic cabling interconnecting adjacent said units in said succession of units.

24. A road traffic signalling system according to claim 15, wherein said electronic signalling units are positioned substantially centrally within a traffic lane of said road.

* * * * *